US006594831B1

(12) United States Patent
Pardo et al.

(10) Patent No.: US 6,594,831 B1
(45) Date of Patent: Jul. 22, 2003

(54) ANTI-SPLASH GUARD

(76) Inventors: Gerardo R. Pardo, 23912 Nine Cir., Land 'O Lakes, FL (US) 34639; Alberto J. Pardo, 908 Hillary Cir., Lutz, FL (US) 33549

( * ) Notice: Subject to any disclaimer, the term of this patent is extended or adjusted under 35 U.S.C. 154(b) by 0 days.

(21) Appl. No.: 10/053,286

(22) Filed: Jan. 18, 2002

(51) Int. Cl.[7] ..... A47K 13/00
(52) U.S. Cl. ..... 4/300.3; 4/255.01
(58) Field of Search ..... 4/300.3, 253, 255.01, 4/255.05, 255.11, 255.12, 245.5; 383/59, 60, 71

(56) References Cited

U.S. PATENT DOCUMENTS 4,458,368 A * 7/1984 Webb ..... 4/300.3
4,762,315 A * 8/1988 Witter
4,831,669 A * 5/1989 Edwards
5,133,607 A * 7/1992 Bonke ..... 383/75
D341,414 S * 11/1993 Baker
5,560,049 A * 10/1996 Robinson et al. ..... 4/253
5,685,018 A * 11/1997 West ..... 2/174
5,706,528 A * 1/1998 Broback ..... 4/253
5,860,170 A * 1/1999 Witt ..... 4/300.3
6,487,730 B2 * 12/2002 Pardo et al. ..... 4/300.3
2002/0184701 A1 * 12/2002 Johnson ..... 4/245.5

* cited by examiner

*Primary Examiner*—Charles R. Eloshway
(74) *Attorney, Agent, or Firm*—Arthur W. Fisher, III

(57) ABSTRACT

An anti-splash guard to enclose the open upper portion of a toilet bowl to shield and contain liquid and matter splashing from the interior thereof when attempting to unclog or dislodge debris from the plumbing when using a plunger including an upper elongated handle and a lower plunger member, the anti-splash guard comprising a cover with or without an upper opening to receive a portion of the upper elongated handle therethrough and a lower opening to receive a portion of the toilet bowl such that when the anti-splash guard is operatively mounted on the toilet with the lower plunger member disposed therein liquid and matter is shielded and contained when splashed therefrom when the plunger is used to dislodge debris from the plumbing.

9 Claims, 8 Drawing Sheets

ANTI-SPLASH GUARD

BACKGROUND OF THE INVENTION

1. Field of the Invention

An anti-splash guard to enclose the open upper portion of a toilet bowl to shield and contain liquid and matter splashing from the interior thereof when attempting to unclog or dislodge debris from the plumbing when using a plunger.

2. Description of the Prior Art

Plungers or plumber's helpers are well known for use to unclog a toilet or associated plumbing. Such plungers normally have a concave hemispherical rubber cup with handle attached. Manual reciprocation of the handle alternately compresses and expands the rubber cup, alternating applying pressure and suction to an obstructed fluid flow line thereby clearing the line. The plunger works best when operated vigorously, which increases the chances for splashing, often directed at the operator.

Numerous devices have been developed to reduce the splashing of liquids, including water, from toilet bowls during operation of such plungers.

U.S. Pat. No. 4,458,368 teaches a device for clearing obstructed soil pipes without splashing water from a sink or toilet bowl comprising an elongate handle having a plunger member at a lower end and an anti-splash shield having a central passage to receive the elongate handle.

U.S. Pat. No. 5,860,170 describes a shield to prevent water from splashing from a toilet bowl when using a plunger in attempting to unplug a clogged toilet or toilet drain comprising a resilient single piece having an outer rim and a flat portion providing a positioning surface against the upper rim of a toilet bowl and a central portion dome shaped concave surface. An aperture is positioned centrally in the dome with the aperture accepting the handle of a toilet plunger forming a frustrum or truncated conical passage way for the toilet handle extending downwardly from the dome.

U.S. Pat. No. 4,589,149 relates to relates to a hygienic covering for the bearing surface of an annular seat of a water closet consisting of a layer of paper, plastified paper or the like in the form of a cylindrical ring including two annular resilient edges provided with elastic bands for providing a covering which can be positioned on the surface of the seat in order to be engaged with one resilient edge with the elastic band at the outer edge and to be kept substantially tensioned above the surface of the seat by means of the other resilient edge with the elastic band.

U.S. Pat. No. 3,858,418 teaches a sanitary diaper handling apparatus which is configured so as to fit standard size diaper pails and which will fit over most toilet bowls in which the diapers are pre-washed. A standard sized diaper pail lid is utilized, the lid having a section of see-through material and two additional openings, each of the openings having a raised lip so that standard rubber gloves may be securely attached to the lid, the rubber gloves extending below the lid itself. This arrangement allows the user to pre-wash soiled diapers and to place them in the standard diaper pail without touching the diapers with the bare hands.

U.S. Pat. No. 5,706,528 shows a system for containing the splashing produced when using a toilet plunger to unclog a flush toilet comprising a substantially flat stiff splash plate to cover the upper opening of a toilet bowl when the plate is rested on the toilet bowl rim. The plate has a central aperture for a plunger handle to freely pass through.

U.S. Pat. No. 5,099,527 discloses a splash deflector for plungers for deflecting splashes having a disc with a circumferential lip on one side thereof. A plurality of stiffening ribs and anti-tearing ribs and openings may be provided on the disc. The disc is positioned on a handle and attached thereto via flaps formed by selectively slitting the disc.

U.S. Pat. No. 5,067,185 describes a toilet bowl protector which fits as a skirt around a toilet bowl comprising a flexible water-proof sheet to cover the exterior surfaces of a toilet bowl and a hole in the central area thereof and an attachment means for enabling the periphery around the hole to be releasably attached to the upper rim of the toilet bowl.

U.S. Pat. No. 4,922,555 teaches a commode plunging shield apparatus including a convex shield formed with a planar lower rim in confronting relationship to a complimentary configured commode rim surface to position the shield in overlying relationship to the commode. An aperture through the crown of an uppermost surface of the commode in alignment with the commode drain pipe slidingly receives a commode plunger therethrough to align the plunger with the commode drain and directs splashing water interiorly of the concave interior surface of the shield to contain such water within the shield and the interior of the commode.

U.S. Pat. No. 4,831,669 shows a splash guard for a toilet bowl to prevent water from splashing out of the toilet bowl when unclogging the toilet by the use of a plunger comprising a flat plate to cover the open upper end of the toilet bowl including a flexible central diaphragm provided with an opening to receive and allow movement of a plunger handle whereby vertical movement of the plunger will not result in water splashing out of the open upper end of the toilet bowl.

U.S. Pat. No. 3,408,661 discloses a decorative cover for a toilet bowl having a top opening including two pieces, a first elongated flexible band having adhesive material on its opposite sides and a unit consisting of a second elongated flexible band having adhesive material only on one side thereof and carrying a skirt for covering the toilet bowl when the skirt and band unit is applied to the edge of the toilet bowl.

Additional examples of prior part are found in U.S. Pat. No. 3,208,092; U.S. Pat. No. 3,085,611 and U.S. Pat. No. Des. 341,414.

SUMMARY OF THE INVENTION

The present invention relates to an anti-splash guard to enclose the open portion of a toilet bowl to shield and contain liquid and matter splashing therefrom when attempting to unclog or dislodge debris when using a plunger. The plunger comprises an upper handle and a lower plunger member.

The anti-splash guard comprises a cover including an upper opening with a handle seal disposed adjacent thereto and a lower opening with a bowl seal disposed adjacent thereto.

The cover comprises a membrane or pliable canopy; while, the handle seal and the bowl seal each comprises a resilient or elastic ring-like or continuous element.

In use, the upper handle is passed through the upper opening with the handle seal sealing the periphery of the upper opening against the upper handle such that the lower plunger member is disposed beneath the membrane or pliable canopy. So assembled, the lower plunger member and the lower portion of the upper handle are placed into the interior of the toilet bowl.

With the anti-splash guard and the plunger so positioned relative to the toilet bowl the bowl seal is placed against the outer surface of the toilet bowl the rim and the toilet seat to seal the lower opening with the upper portion of the toilet bowl and around the toilet seat. The anti-splash guard may be used with the seat in either the up or down position with equal performance.

With lower plunger member placed over the lower portion of the toilet or associated plumbing, the upper handle of the plunger is vigorously moved up and down to dislodge or unclog debris from the lower portion of the toilet or associated plumbing with the membrane or pliable canopy of the anti-splash guard shielding and containing liquid or matter splashing from the interior of the toilet bowl.

When the process is complete, the toilet is flushed with the anti-splash guard in place to assist in containing any liquid or matter overflow if plunging is unsuccessful.

Then the anti-splash guard and the plunger are removed from the toilet bowl. Finally, the anti-splash guard is removed from the upper elongated handle and disposed of.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
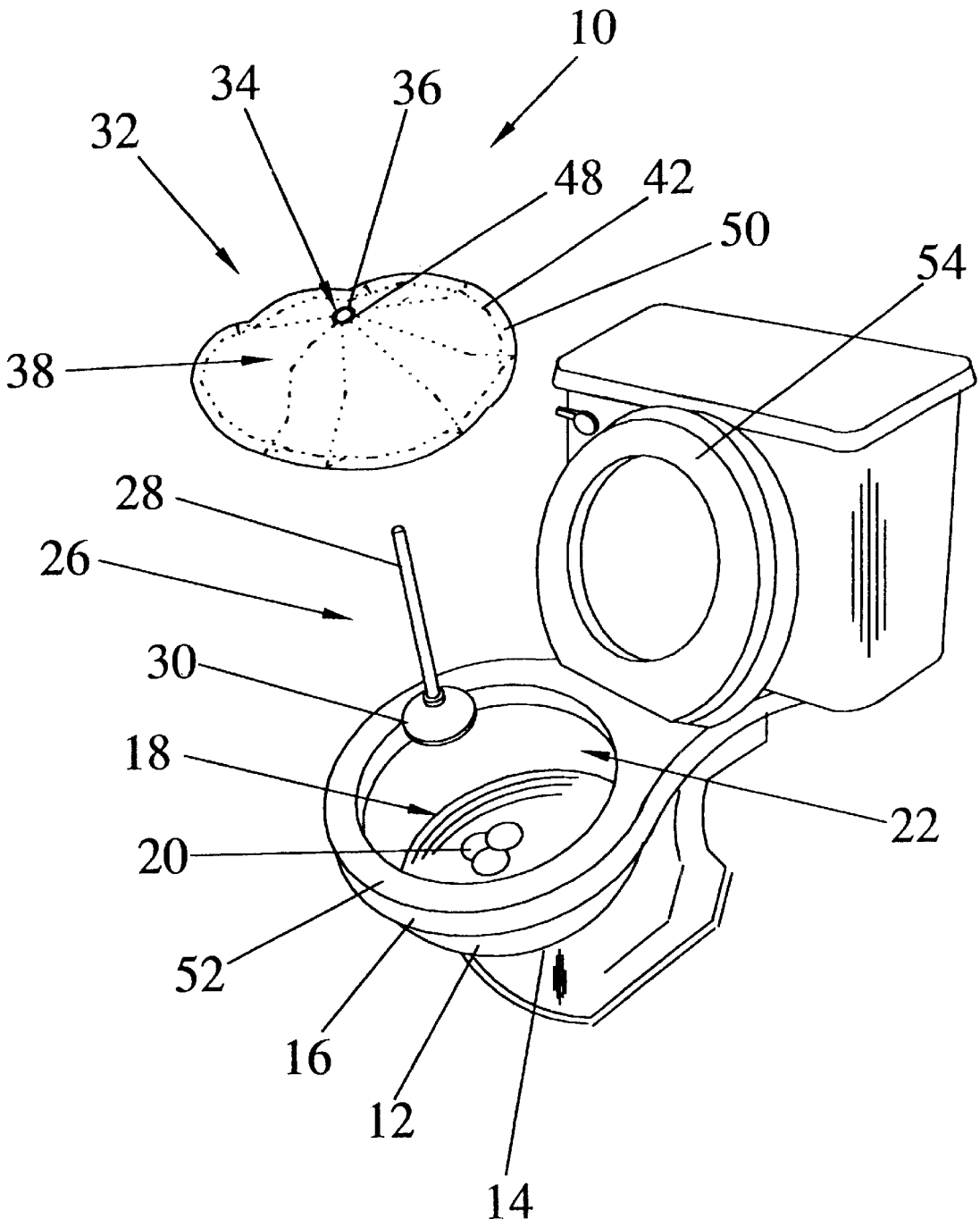
FIG. 1 is a perspective exploded view of the anti-splash guard of the present invention in combination with a plunger and toilet.
Figure 2:
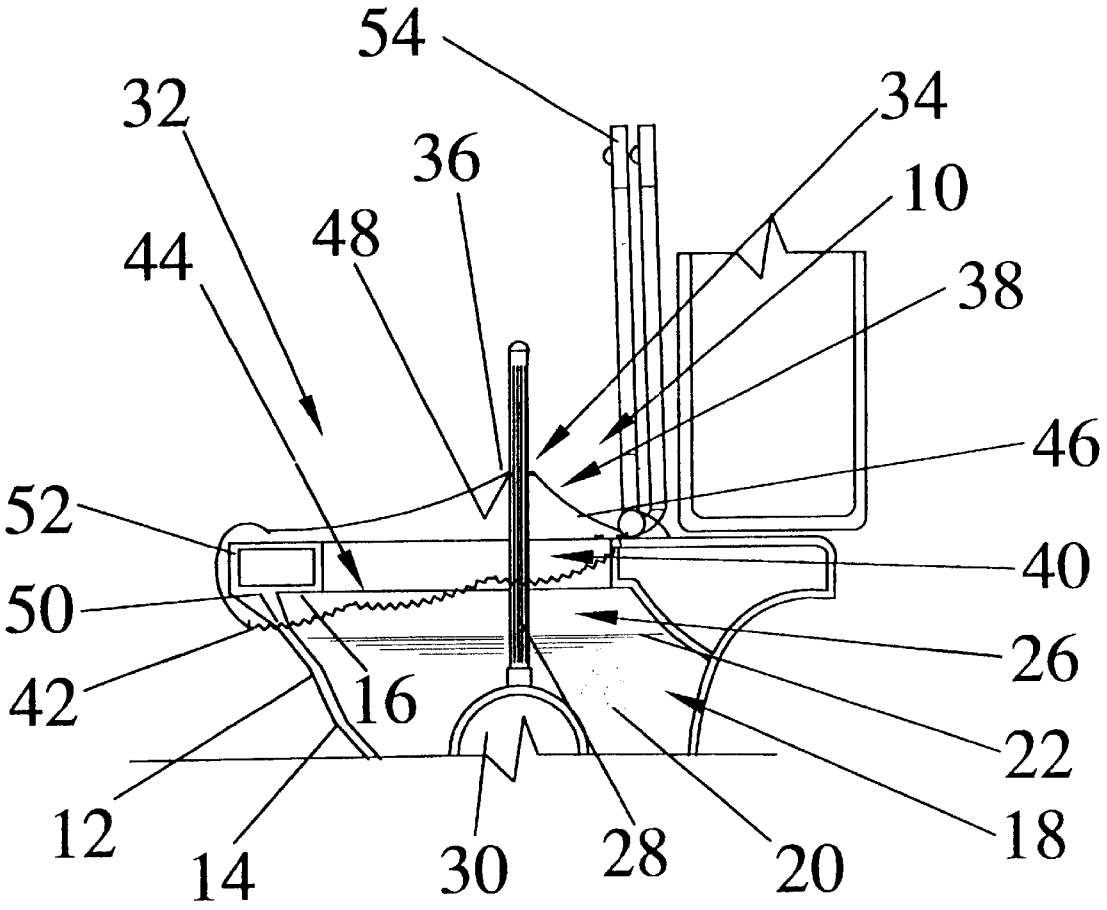
FIG. 2 is a partial cross-sectional side view of the anti-splash guard of the present invention shown in FIG. 1 in combination with a plunger and toilet with the anti-splash guard positioned on the toilet and the plunger in the operative position.

As shown in FIGS. 1 and 2, the present invention relates to an anti-splash guard generally indicated as 10 to enclose the open upper end portion 12 of a toilet bowl 14 adjacent the rim 16 thereof to shield and contain liquid 18 and matter 20 splashing from the interior 22 thereof when attempting to unclog or dislodge debris (not shown) from the lower portion of the toilet or associated plumbing beneath the toilet (not shown) when using a plunger generally indicated as 26. The plunger 26 comprises an upper elongated handle 28 and a hemispherical lower plunger member or concave cup 30.

The anti-splash guard 10 comprises a cover generally indicated as 32 including a centrally disposed upper minor opening 34 having a periphery 36 with a handle seal generally indicated as 38 disposed adjacent thereto and a lower major opening 40 having a periphery 42 with a bowl seal generally indicated as 44 disposed adjacent thereto.

The cover 32 comprises a membrane or pliable canopy 46; while, the handle seal 38 and the bowl seal 44 comprise a first resilient or elastic ring-like or continuous element 48 and a second resilient or elastic ring-like or continuous element 50 respectively.

In use, the upper elongated handle 28 of the plunger 26 is passed through the centrally disposed upper minor opening 34 with the first resilient or elastic ring-like or continuous element 48 sealing the periphery 36 of the centrally disposed upper minor opening 34 against the upper elongated handle 28 of the plunger 26 such that the lower plunger member or concave cup 30 is disposed beneath the membrane or pliable canopy 46 of the cover 32. So assembled, the lower plunger member or concave cup 30 and the lower portion of the upper elongated handle 28 are placed into the interior 22 of the toilet bowl 14.

With the anti-splash guard 10 and the plunger 26 so positioned relative to the toilet bowl 14, the second resilient or elastic ring-like or continuous element 50 is placed against the outer surface 52 of the upper portion 12 of the toilet bowl 14 below the rim 14 and the toilet seat 54 to seal the periphery 42 of the lower major opening 40 with the upper portion 12 of the toilet bowl 14 and around the toilet seat 54.

With lower plunger member or concave cup 30 of the plunger 26 placed over the lower portion of the toilet or associated plumbing (not shown), the upper elongated handle 28 of the plunger 26 is vigorously moved up and down to dislodge or unclog debris from the lower portion of the toilet or associated plumbing (not shown) with the membrane or pliable canopy 46 of the cover 32 of the anti-splash guard 10 shielding and containing liquid 18 or matter 20 splashing from the interior 22 of the toilet bowl 14.

When the process is complete, the anti-splash guard 10 and the plunger 26 are removed from the toilet bowl 14. The anti-splash guard 10 is removed from the upper elongated handle 28 and disposed of.

Figure 3:
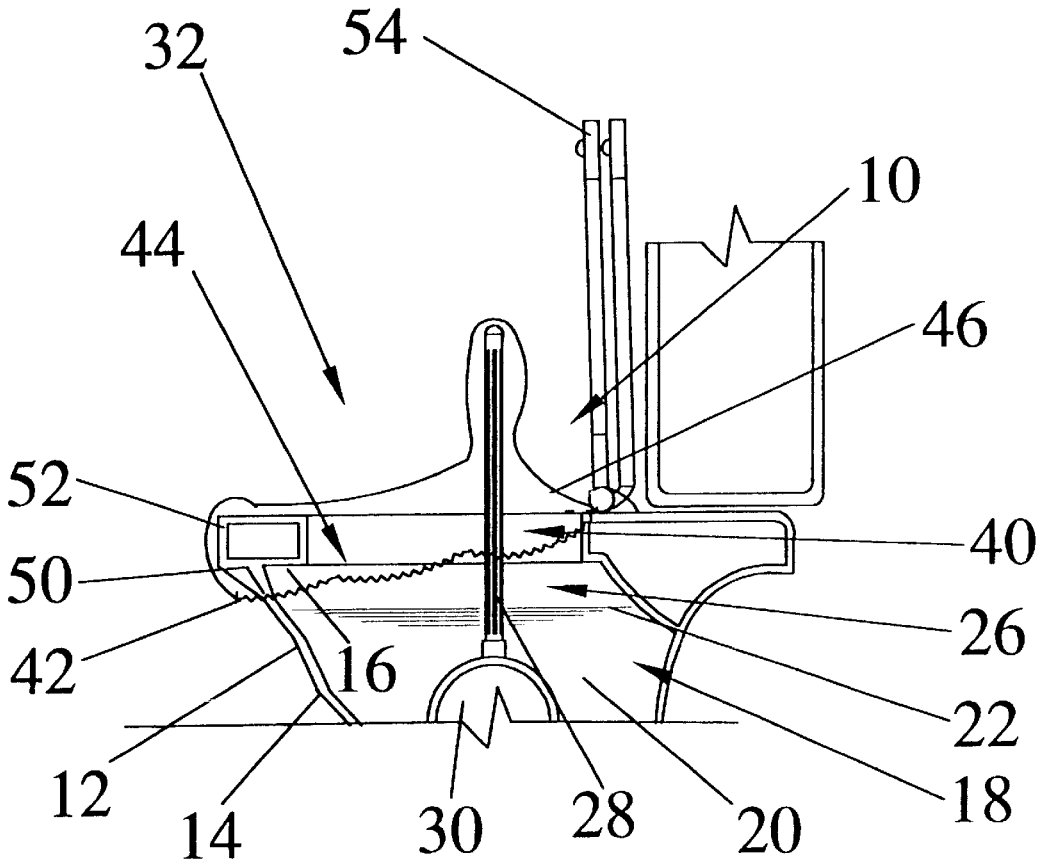
FIG. 3 is a partial cross-sectional side view of an alternate embodiment of the anti-splash guard of the present invention in combination with a plunger and toilet.
Figure 4:
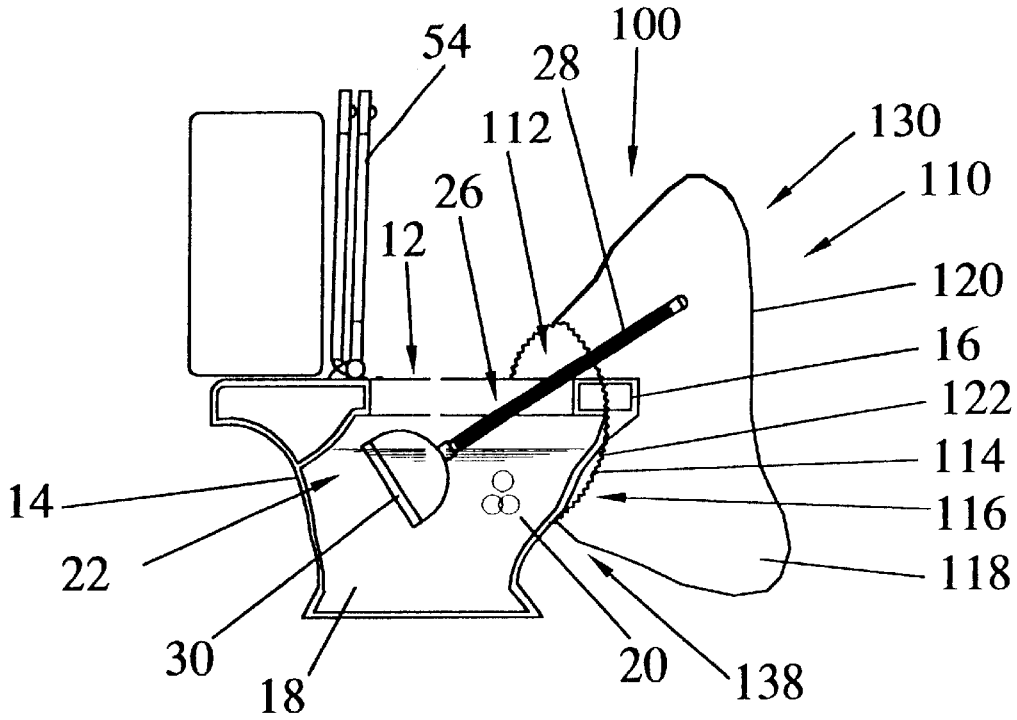
FIG. 4 is a cross-sectional side view of another alternate embodiment of the anti-splash guard of the present invention in combination with a plunger and toilet with the anti-splash guard partially positioned on the toilet.
Figure 5:
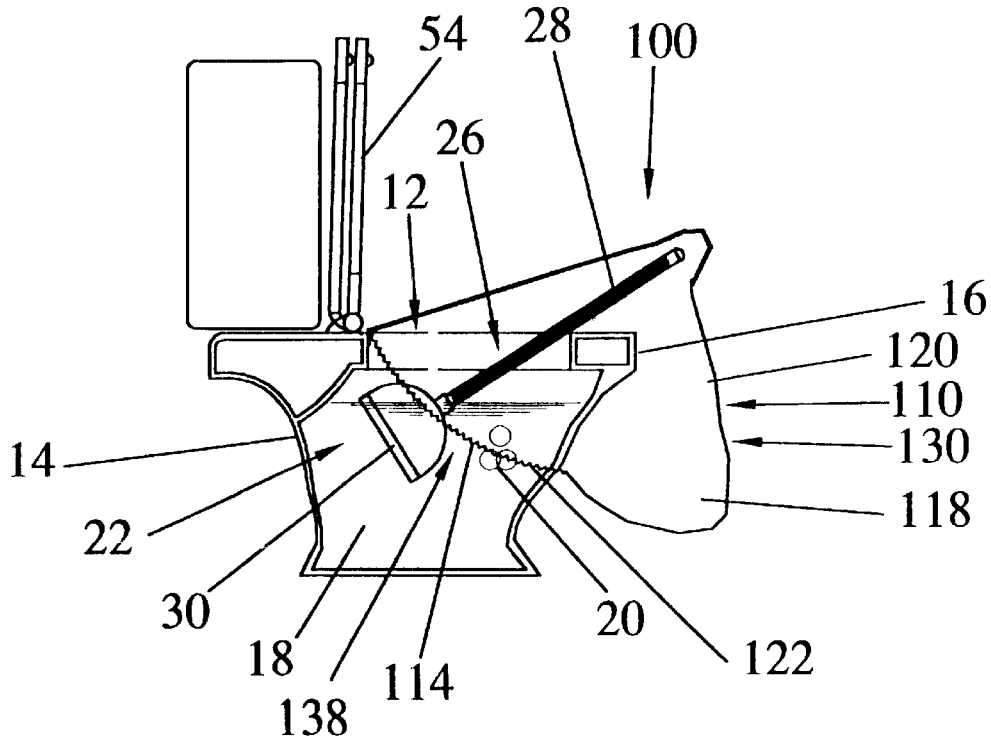
FIG. 5 is a cross-sectional side view of another alternate embodiment of the anti-splash guard of the present invention shown in FIG. 4 in combination with a plunger and toilet with the anti-splash guard fully positioned on the toilet.
Figure 6:
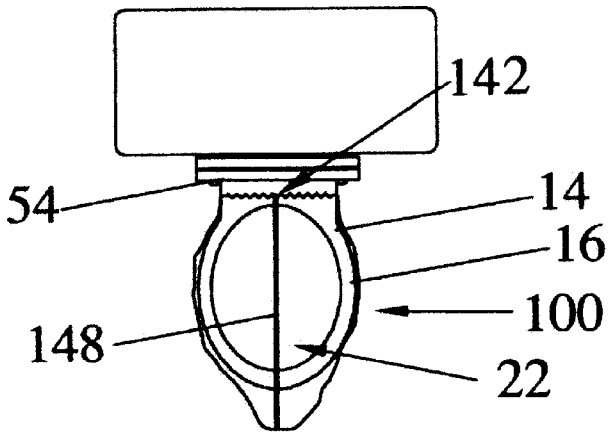
FIG. 6 is a top view of another alternate embodiment of the anti-splash guard of the present invention shown in FIG. 4 in combination with a plunger and toilet with the anti-splash guard fully positioned on the toilet.
Figure 7:
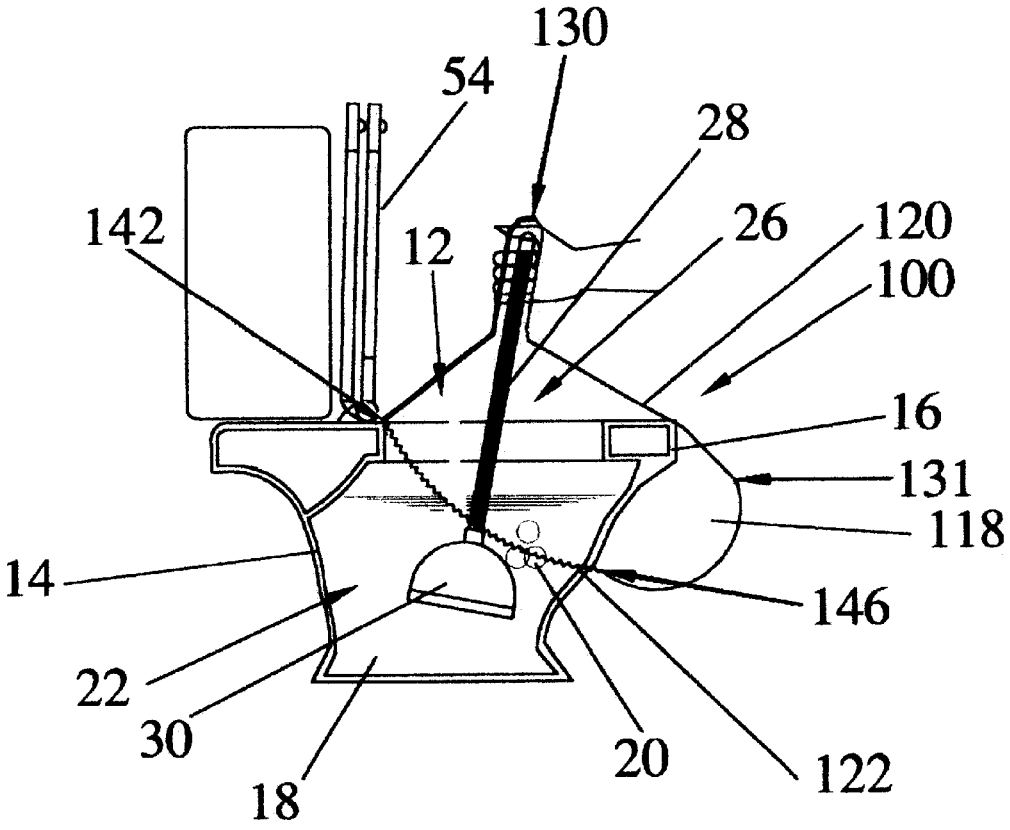
FIG. 7 is a partial cross-sectional side view of another alternate embodiment of the anti-splash guard of the present invention shown in FIG. 4 in combination with a plunger and toilet with the anti-splash guard positioned on the toilet and the plunger in the operative position.

FIG. 3 shows an alternate embodiment of the anti-splash guard 10 with similar structural elements similarly designated. Specifically, the anti-splash guard 10 comprises a cover generally indicated as 32 including a lower major opening 40 having a periphery 42 with a bowl seal generally indicated 44 disposed adjacent thereto.

The cover 32 comprises a membrane or pliable canopy 46; while, the bowl seal 44 comprises a resilient or elastic ring-like or continuous element 50.

In use, the upper elongated handle 28 of the plunger 26 is at least partially disposed with the membrane or pliable canopy 46 such that the lower plunger member or concave cup 30 is disposed beneath the membrane or pliable canopy 46 of the cover 32. So assembled, the lower plunger member or concave cup 30 and the lower portion of the upper elongated handle 28 are placed into the interior 22 of the toilet bowl 14.

With the anti-splash guard 10 and the plunger 26 so positioned relative to the toilet bowl 14, the resilient or elastic ring-like or continuous element 50 is placed against the outer surface 52 of the upper portion 12 of the toilet bowl 14 below the rim 14 and the toilet seat 54 to seal the periphery 42 of the lower major opening 40 with the upper portion 12 of the toilet bowl 14 and around the toilet seat 54.

With lower plunger member or concave cup 30 of the plunger 26 placed over the lower portion of the toilet or associated plumbing (not shown), the upper elongated handle 28 of the plunger 26 is vigorously moved up and down to dislodge or unclog debris from the lower portion of the toilet or associated plumbing (not shown) with the membrane or pliable canopy 46 of the cover 32 of the anti-splash guard 10 shielding and containing liquid 18 or matter 20 splashing from the interior 22 of the toilet bowl 14.

When the process is complete, the anti-splash guard 10 and the plunger 26 are removed from the toilet bowl 14. The anti-splash guard 10 is removed from the upper elongated handle 28 and disposed of.

FIGS. 4 through 7 show another alternate embodiment of an anti-splash guard generally indicated as 100. Specifically, the anti-splash guard 100 comprises a cover generally indicated as 110 including a bowl receiving opening 112 having a periphery 114 with a bowl seal generally indicated as 116 disposed adjacent thereto and a bulbous effluent trap or pocket 118.

The cover 110 comprises a membrane or pliable canopy 120; while, the bowl seal 116 comprise a resilient or elastic ring-like or continuous element 122.

Figure 8:
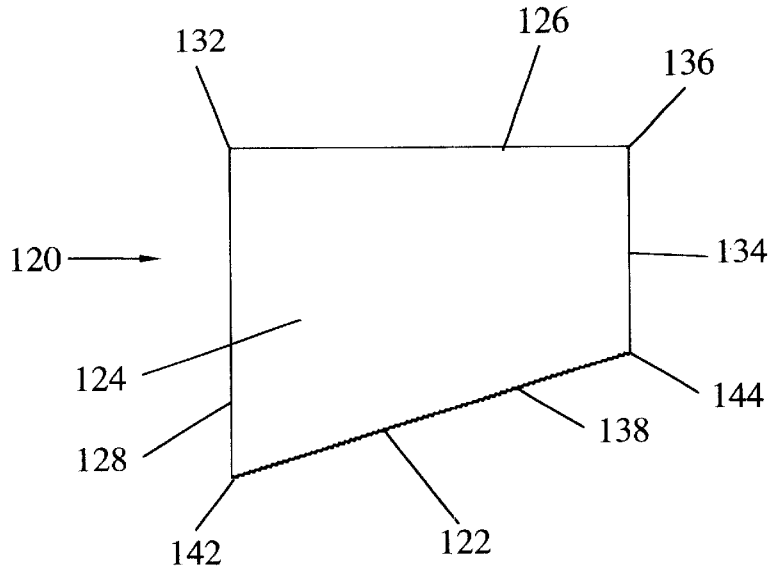
FIG. 8 is a top view of one panel of the anti-splash guard of the embodiment of the present invention shown in FIGS. 4 through 7.
Figure 9:
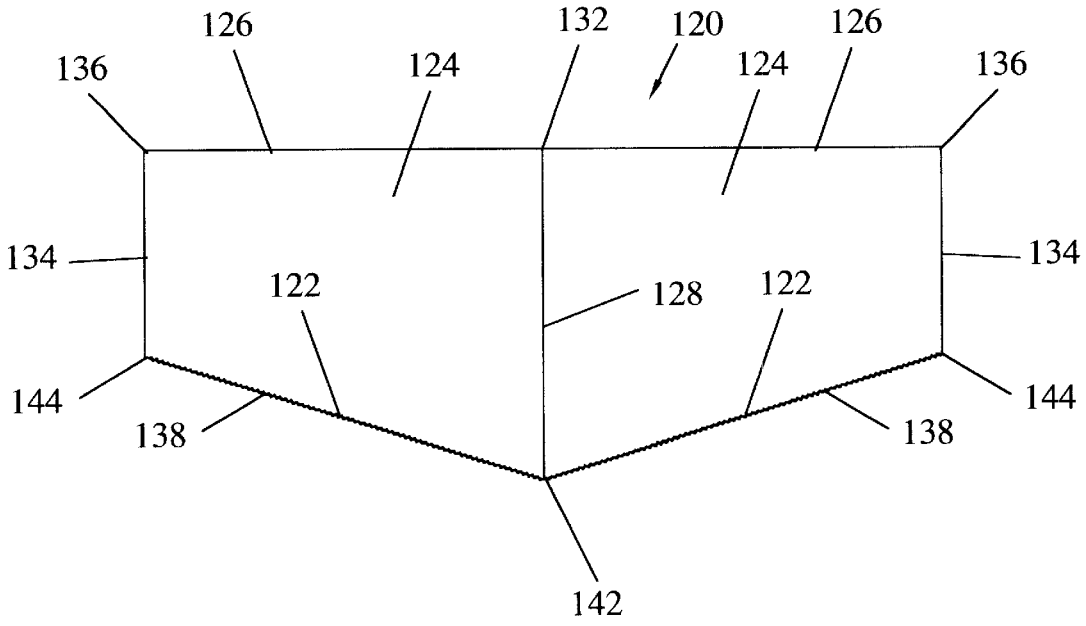
FIG. 9 is a top view of the two panels of the anti-splash guard of the embodiment of the present invention shown in FIGS. 4 through 7.

The construction of the member or pliable canopy 120 can best be understood with reference to FIGS. 8 and 9. In particular, the membrane or pliable canopy 120 comprises a pair of panels each indicated as 124 sealed together on a first sealed side or edge 126 that intersects a second sealed side or edge 128 at the upper front portion generally indicated as 130 (FIG. 7) of the membrane or pliable canopy 120 at 132 and a third sealed side or edge 134 that intersects the first sealed side or edge 126 at the lower front portion generally indicated as 131 (FIG. 7) of the membrane or pliable canopy 120 at 136 and an unsealed side or edge 138 that intersects the second sealed side or edge 128 at 142 and the third sealed side or edge 134 at 144 at the front portion generally indicated as 146 (FIG. 7) of the membrane or pliable canopy 120.

The length of unsealed side or edge 138 is about the length of the second sealed side or edge 128 and greater than the length of the first sealed side or edge 126 which is greater than the length of third sealed side or edge 134. The length of the unsealed side or edge 138 and second sealed side or edge 128 is about at least thirty-six (36") inches; which, the length of the first sealed side or edge 126 is about at least thirty-three (33") inches which is about at least twice the length of third sealed side or edge 134 of about at least sixteen (16") inches.

The resilient or elastic ring-like or continuous element 122 is formed or affixed adjacent the unsealed side or edge 138 to form the bowl receiving opening 112.

To use the anti-splash guard 110, the toiled seat 54 is lifted. The plunger 26 is placed in a toilet bowl 14 with handle 28 facing forward. The user then holds the cover 110 with black line or alignment indicator 148 (FIG. 6) facing up and places the cover 110 over plunger handle 28 and under belly of toilet bowl 14. The plunger 26 is then pumped to dislodge the debris as previously described. The cover 110 is then carefully removed with the effluent trapped or retained in the bulbous effluent trap pocket 118.

Figure 10:
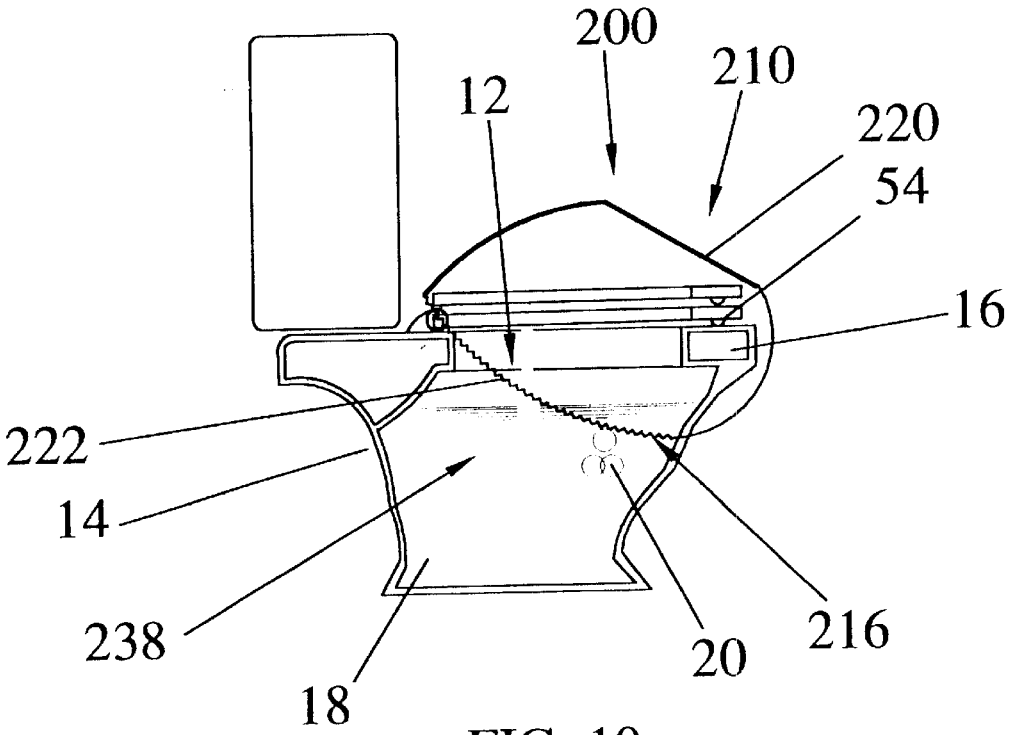
FIG. 10 is a partial cross-sectional side view of yet another embodiment of the anti-splash guard of the present invention partially installed on a toilet.
Figure 11:
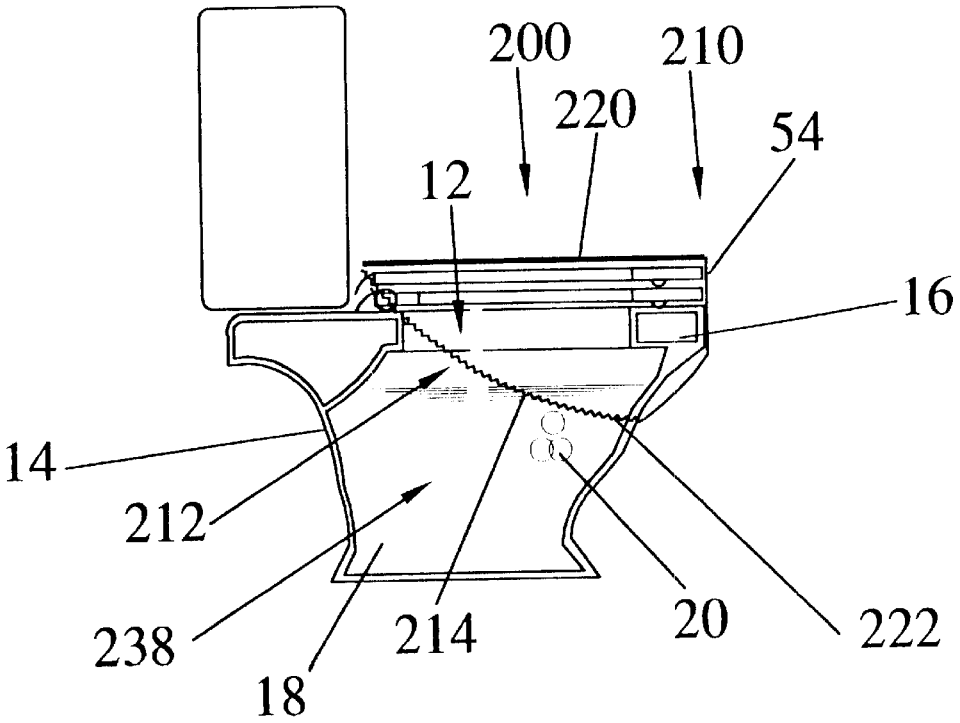
FIG. 11 is a partial cross-sectional side view of yet another embodiment of the anti-splash guard of the present invention shown in FIG. 11 installed on a toilet.

FIGS. 10 through 11 show yet another alternate embodiment of the anti-splash guard generally indicated as 200. Specifically, the anti-splash guard 200 comprises a cover generally indicated as 210 including a bowl receiving opening 212 having a periphery 214 with a bowl seal generally indicated as 216 disposed adjacent thereto.

The cover 210 comprises a membrane or pliable canopy 220 while, the bowl seal 216 comprise a resilient or elastic ring-like or continuous element 222.

Figure 12:
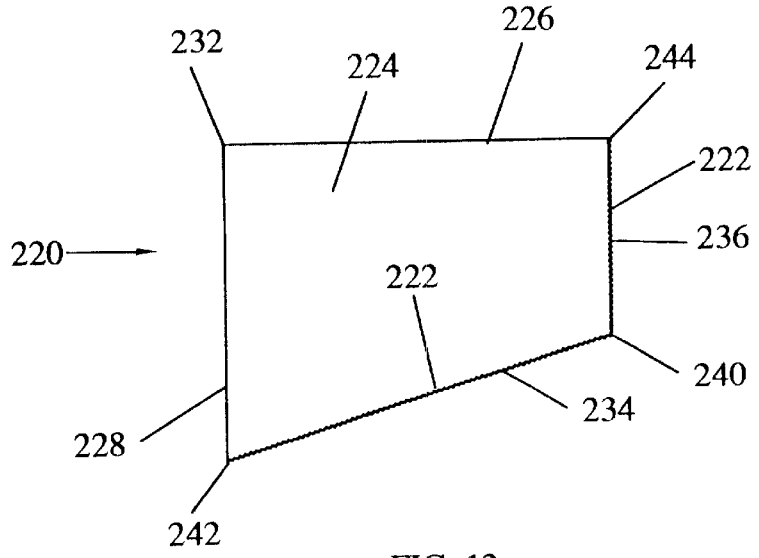
FIG. 12 is a top view of one panel of the anti-splash guard of the embodiment of the present invention shown in FIGS. 10 and 11.
Figure 13:
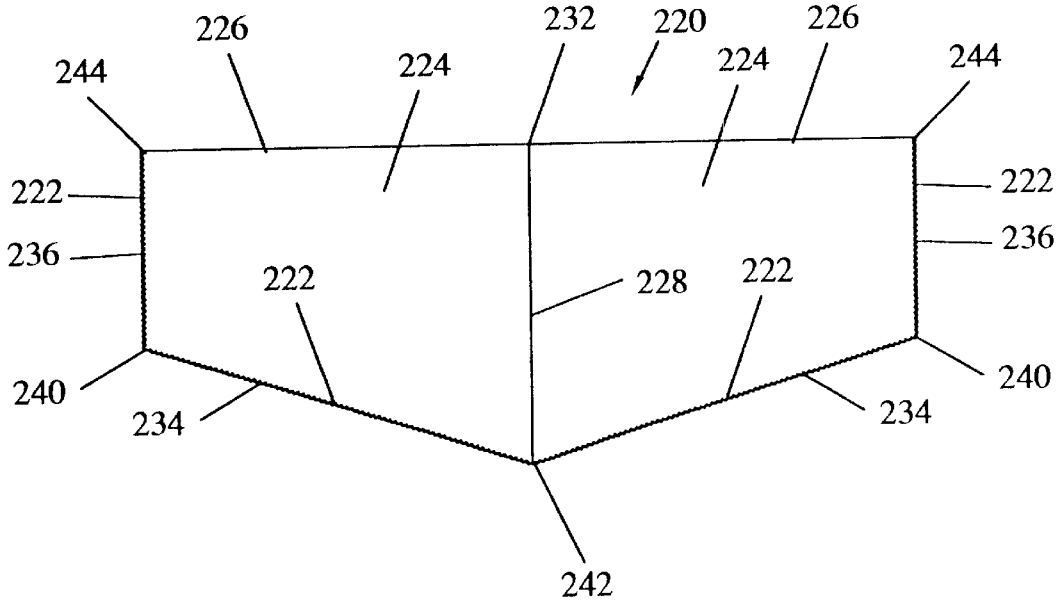
FIG. 13 is a top view of two panels of the anti-splash guard of the embodiment of the present invention shown in FIGS. 10 and 11.

The construction of the member or pliable canopy 220 can best be understood with reference to FIGS. 12 and 13. In particular, the membrane or pliable canopy 220 comprises a pair of panels each indicated as 224 sealed together on a first sealed side or edge 226 and a second sealed side or edge 228 that intersect at 232 and unsealed on a first unsealed side or edge 234 and a second unsealed side or edge 236 that intersect at 240

As best shown in FIG. 13, the first unsealed side or edge 234 intersects the second sealed side or edge 228 at 242; while, the second unsealed side or edge 236 intersects the first sealed side or edge 226 at 244.

The length of first unsealed side or edge 234 is greater than the length of the first sealed side or edge 226 which is greater than the length of second sealed side or edge 228 which is greater than the length of the second unsealed side or edge 236. The length of the second sealed side or edge 228 is about at least twenty four (24") inches which is about at least twice the length of second unsealed side or edge 236 of about at least twelve (12") inches; while, the length of the first sealed side or edge 126 of about at least twenty-seven (27") inches.

The resilient or elastic ring-like or continuous element 222 is formed or affixed adjacent the first unsealed side or edge 234 and the second unsealed side or edge 236 to form the bowl receiving opening 212.

To position on the toilet bowl 14, the toilet seat 54 is closed and the elastic or resilient element 222 is placed over the toilet to prevent access or use of the toilet until repaired.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. An anti-splash guard to enclose the open upper portion of a toilet bowl to shield and contain liquid and matter splashing from the interior thereof when attempting to unclog or dislodge debris from the plumbing when using a plunger including an upper elongated handle and a lower plunger member, said anti-splash guard comprising a cover including a pliable canopy having a lower opening with an elastic element disposed adjacent the periphery thereof to receive a portion of the outside surface of the toilet bowl and to seal said anti-splash guard against the outside of the toilet and a bulbous effluent trap disposed adjacent said lower opening such that liquid and debris in the toilet is contained by said anti-splash guard as the plunger dislodges debris whereby debris and liquid is collected in said bulbous effluent trap.

2. The anti-splash guard of claim 1 wherein said pliable canopy comprises a pair of panels having a first sealed side, a second sealed side and a third sealed side, and an unsealed side.

3. The anti-splash guard of claim 2 wherein the length of said unsealed side is about the length of said second sealed side and greater than the length of said first sealed side which is greater than the length of said third sealed side.

4. The anti-splash guard of claim 3 wherein the length of said unsealed side and said second sealed side is about at least thirty-six (36") inches; the length of said first sealed side is about at least thirty-three (33") inches and the length of said third sealed side is about at least sixteen (16") inches.

5. The anti-splash guard of claim 2 wherein said elastic element is disposed adjacent said unsealed side to form said bowl receiving opening.

6. An anti-splash guard to enclose the open upper portion of a toilet bowl to shield and contain liquid and matter splashing from the interior thereof when attempting to unclog or dislodge debris from the plumbing when using a plunger including an upper elongated handle and a lower plunger member, said anti-splash guard comprising a cover including a pliable canopy having a lower opening with an elastic element disposed adjacent the periphery thereof to receive a portion of the outside surface of the toilet bowl and to seal said anti-splash guard against the outside of the toilet and a bulbous effluent trap disposed adjacent said lower opening such that liquid and debris in the toilet is contained by said anti-splash guard as the plunger dislodges debris whereby debris and liquid is collected in said bulbous effluent trap, said pliable canopy comprises a pair of panels having a first sealed side, a second sealed side and a third sealed side, and an unsealed side.

7. An anti-splash guard to enclose the open upper portion of a toilet bowl to shield and contain liquid and matter splashing from the interior thereof when attempting to unclog or dislodge debris from the plumbing when using a plunger including an upper elongated handle and a lower plunger member, said anti-splash guard comprising a cover including a pliable canopy having a lower opening with an elastic element disposed adjacent the periphery thereof to receive a portion of the outside surface of the toilet bowl and to seal said anti-splash guard against the outside of the toilet and a bulbous effluent trap such that liquid and debris in the toilet is contained by said anti-splash guard as the plunger dislodges debris whereby debris and liquid is collected in said bulbous effluent trap, said pliable canopy comprises a pair of panels having a first sealed side, a second sealed side, a third sealed side and an unsealed side wherein the length of said unsealed side is about the length of said second sealed side and greater than the length of said first sealed side which is greater than the length of said third sealed side.

8. An anti-splash guard to enclose the open upper portion of a toilet bowl to shield and contain liquid and matter splashing from the interior thereof when attempting to unclog or dislodge debris from the plumbing when using a plunger including an upper elongated handle and a lower plunger member, said anti-splash guard comprising a cover including a pliable canopy having a lower opening with an elastic element disposed adjacent the periphery thereof to receive a portion of the outside surface of the toilet bowl and to seal said anti-splash guard against the outside of the toilet and a bulbous effluent trap such that liquid and debris in the toilet is contained by said anti-splash guard as the plunger dislodges debris whereby debris and liquid is collected in said bulbous effluent trap, said pliable canopy comprises a pair of panels having a first sealed side, a second sealed side, a third sealed side and an unsealed side wherein the length of said unsealed side and said second sealed side is about at least thirty-six (36") inches; the length of said first sealed side is about at least thirty-three (33") inches and the length of said third sealed side is about at least sixteen (16") inches.

9. An anti-splash guard to enclose the open upper portion of a toilet bowl to shield and contain liquid and matter splashing from the interior thereof when attempting to unclog or dislodge debris from the plumbing when using a plunger including an upper elongated handle and a lower plunger member, said anti-splash guard comprising a cover including a pliable canopy having a lower opening with an elastic element disposed adjacent the periphery thereof to receive a portion of the outside surface of the toilet bowl and to seal said anti-splash guard against the outside of the toilet and a bulbous effluent trap disposed adjacent said lower opening such that liquid and debris in the toilet is contained by said anti-splash guard as the plunger dislodges debris whereby debris and liquid is collected in said bulbous effluent trap, said pliable canopy comprises a pair of panels having a first sealed side, a second sealed side, a third sealed side and an unsealed side wherein said elastic element is disposed adjacent said unsealed side to form said bowl receiving opening.

* * * * *